US006494336B1

(12) United States Patent
Bylo

(10) Patent No.: US 6,494,336 B1
(45) Date of Patent: Dec. 17, 2002

(54) MODULAR COMBAT LOAD SYSTEM

(75) Inventor: John Michael Bylo, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/983,044

(22) Filed: Oct. 17, 2001

(51) Int. Cl.[7] ..... B65D 21/036

(52) U.S. Cl. ..... 220/23.88; 220/23.6; 220/23.89; 206/597

(58) Field of Search ..... 220/23.88, 23.6, 220/23.89; 206/597

(56) References Cited

U.S. PATENT DOCUMENTS 2,010,812 A * 8/1935 Devine ..... 206/499
2,960,250 A * 11/1960 Haloski ..... 206/499
3,445,050 A * 5/1969 Peters et al. ..... 220/23.88
4,195,728 A * 4/1980 Cardamone ..... 206/497
5,216,947 A * 6/1993 Cheng ..... 126/348
6,189,330 B1 * 2/2001 Retallick et al. ..... 220/23.88
6,209,725 B1 * 4/2001 Chen ..... 206/508

* cited by examiner

*Primary Examiner*—Joseph M. Moy
(74) *Attorney, Agent, or Firm*—David Kalmbaugh

(57) ABSTRACT

A modular combat load system which is portable, light weight and easily moved from one location to another and which allows the military to supply troops with mission critical consumable supplies, such as drinking water, in a combat environment. The system has sixteen modular combat load units stacked on a pallet. Each modular combat unit has a water/fuel module positioned at the upper end of the unit, a mission requirements module which comprises the lower portion of unit and a field pack module assembly which is positioned within a cavity formed within the interior of the mission requirements module. The field pack module assembly holds a plurality of field pack storage units which are stacked on top of one another within the tray. The field pack storage units are of sufficient size to hold one day of consumable supplies for use by a soldier in a combat environment.

21 Claims, 6 Drawing Sheets

MODULAR COMBAT LOAD SYSTEM

BACKGROUND OF THE INVENTION

1. Field of the Invention

The present invention relates generally to a system for supplying the military with mission critical consumable supplies in a combat environment. More specifically, the present invention relates to a modular combat load system which is portable, light weight and is easily moved from one location to another location and which provides an efficient means for supplying the military with mission critical consumable supplies, such as drinking water, in a hostile or combat environment.

2. Description of the Prior Art

Currently, the supply of combat loads to military ground forces ashore is unique among supply scenarios in that it is driven by a time critical need for system responsiveness to unplanned material requests that are often emergency situations dealing with life and death. In particular, the timely resupply of consumables to troops ashore is a unique requirement of the military when in a combat or hostile environment and is substantially different from standard assault logistics operations.

There is also a need for a modular combat load system which comprises a one-way disposable system which allows for standardized multi-product containers that will increase the range capability of the combat service support function and improve the efficiency of the cargo delivery process.

The modular combat load system must allow for (1) a standard unit of distribution and unit of issue; (2) for a seamless flow of supplies from manufacturer to user; (3) provide for the different standard missions that the marines and other land based military personnel train for; and (4) allow for integration with logistic material movement handling equipment currently in use by the military.

SUMMARY OF THE INVENTION

The present invention overcomes some of the disadvantages of the past including those mentioned above in that it is a relatively simple in design yet offers a highly effective modular combat load system which when deployed will allow for the transport of mission critical consumable supplies, such as drinking water, to a hostile or combat environment that is beyond the reach of powered material handling equipment. This modular combat load system will then allow combat troops to carry out their mission in hostile or combat environment where conventional material handling equipment cannot operate.

The modular combat load system is portable, light weight and easily moved from one location to another location and also provides a means for the military to supply troops with mission critical consumable supplies, such as drinking water, rations, ammunition and medical supplies, in a wide range of combat environments. The system includes sixteen modular combat load units stacked on a 48 inch by 42 inch pallet. Each modular combat unit has a water/fuel module which comprises the upper portion of the unit, a mission requirements module which comprises the lower portion of unit and a field pack module assembly which is positioned within a cavity formed within the interior of the mission requirements module. The field pack module assembly holds a plurality of field pack storage units which are stacked on top of one another within the tray.

The water/fuel module of each unit contains about 5.00 gallons of water and may be fabricated from a light weight, clear plastic or polymer. When used to carry fuel, the module is fabricated from a strong cross linked polymer which is opaque to light. The field pack storage units are of sufficient size to hold one day of consumable supplies for use by a soldier in a combat environment.

The interior of mission requirements module may be used to store additional medical supplies, food and water, ammunition and other consumables used by military troops in a combat area.

DETAILED DESCRIPTION OF THE PREFERRED EMBODIMENTS

Figure 1:
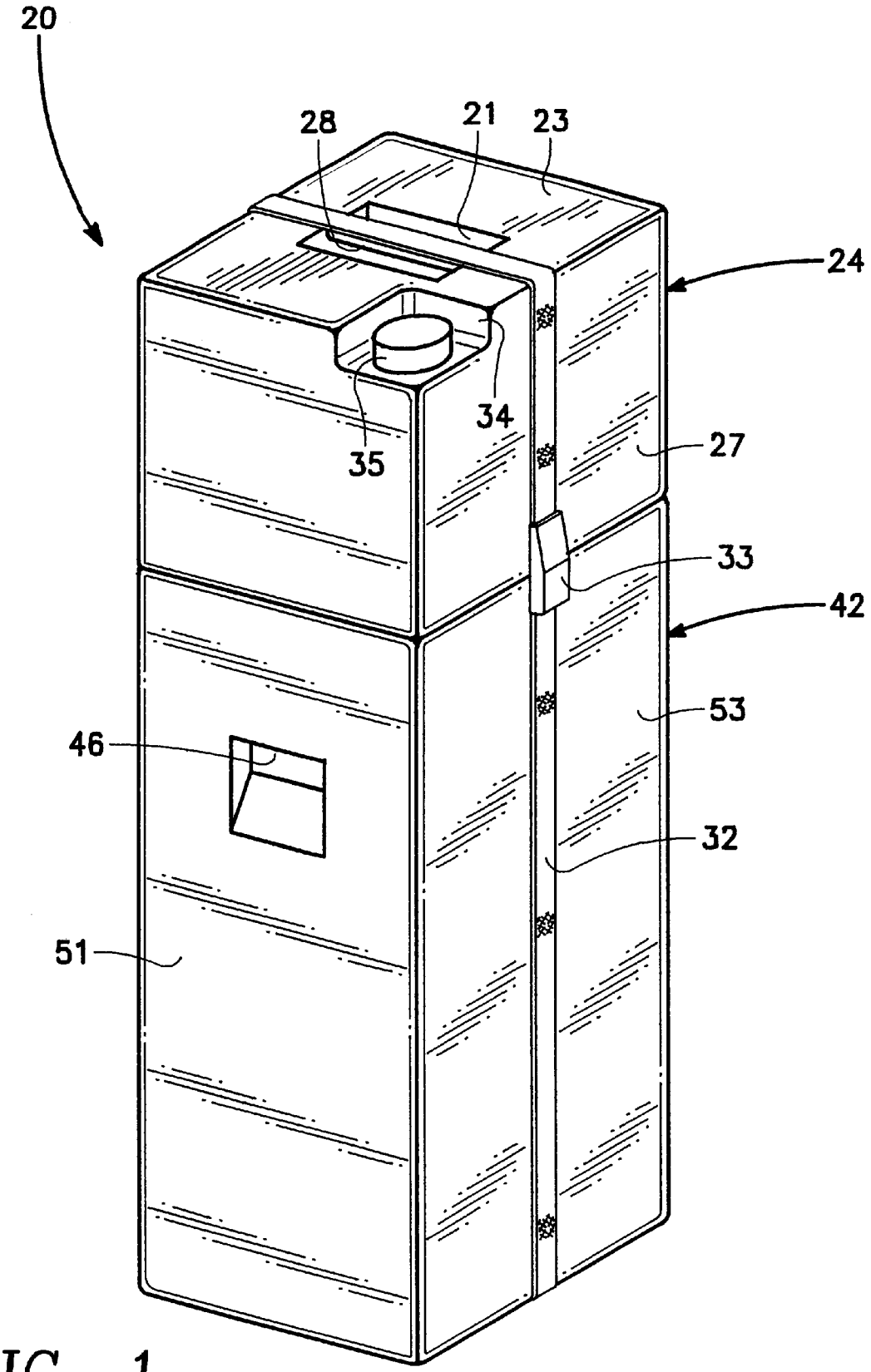
FIG. 1 s a perspective view of illustrating a modular combat load unit for storing consumable products for use by a soldier in a combat environment which constitutes a preferred embodiment of the present invention.
Figure 2:
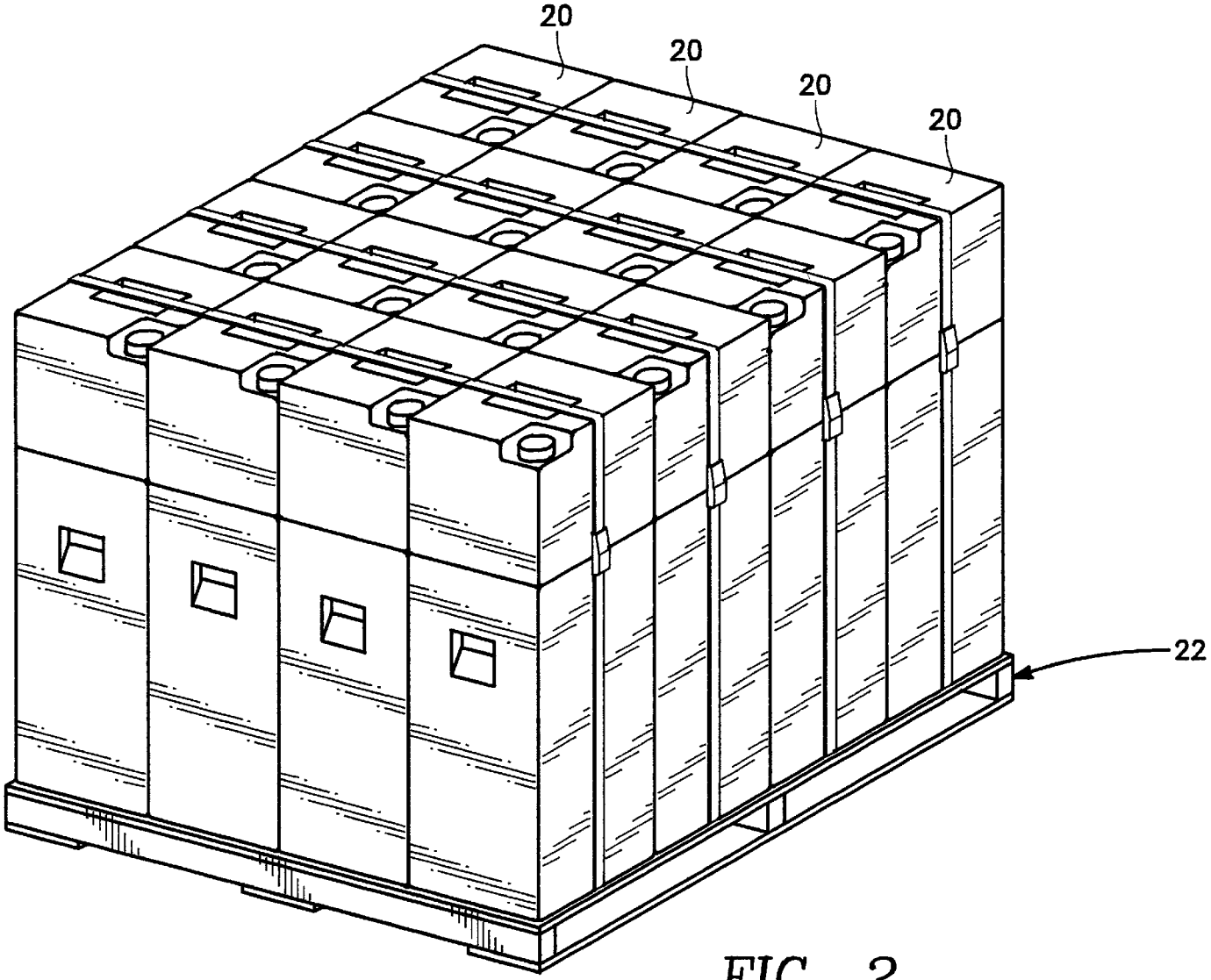
FIG. 2 illustrates a pallet upon which sixteen modular combat load units of the type shown in FIG. 1 are stacked.

Referring first to FIGS. 1 and 2, there are shown sixteen modular combat load units 20 stacked on a pallet 22 for use by a squad of marines, army or other United States combat troops in a hostile or combat environment. The pallet 22 upon which the load units 20 are stacked has dimensions of 48 inches long by 48 inches wide by 42 inches high. The pallet 22 supports a weight of 4000 lbs. and a volume of 56 cubic feet.

Each modular combat load unit 20 is designed for an individual soldier within a squad and provides the required consumable products for the individual for one day of operations in a hostile or combat environment. Each modular combat unit 20 has overall dimensions of 12 inches long by 12 inches wide by 42 inches high and an approximate weight of 130.33 lbs. which allows for a universally transportable logistics supply load on a pallet ready for direct delivery to a battle front by air delivery from a sea base.

Referring to FIGS. 1, 3, 4 and 5, the modular combat load unit 20 includes a water/fuel module 24 positioned at the upper end of the unit 20. When used to carry water, the water/fuel module 24 of each unit 20 contains about 5.00 gallons of water at a weight of 31.5 lbs and may be fabricated from a light weight, clear plastic or polymer. When used to carry fuel, module 24 is fabricated from a polymer which is transparent to light. The overall dimensions of water/fuel module 24 are 12 inches long by 12 inches wide by 12 inches high.

Module 24 has a generally rectangular shaped wash basin 26 formed within the interior of module 24 in the lower half of module 24. Wash basin 26 has a depth of about five inches and allows a soldier, for example, to clean wounds which occur in a combat environment. The cavity 29 between wash basin 26 and the upper end 23 of water module 24 is used for storage of water or fuel.

The width of wash basin 26 is about 8.125 inches. Positioned within a recess 21 on the top or upper end 23 of water module 24 is a centrally located handle 28 which is integrally formed within module 24. Handle 28 allows a user of module to transport module 24 from one location to another location when module 24 is separated from modular combat load unit 20.

Module 24 includes a centrally located one eight inch indent 30 which is adapted to receive a channel strap 32. Indent 30 runs across the top or upper end 23 of module 24 and is vertically positioned on opposite side walls 25 and 27 of module 24. Channel strap 32, which includes a buckle assembly 33, fits within indent 30 and is used to secure the module 24 to a mission requirements module 42.

Located in one corner of the top 23 of module 24 is a generally rectangular shaped recess 34 which has a cylindrical shaped threaded member 35 and its associated orifice 36 extending vertically upward from recess 34. Threaded member 36, which includes 6 threads/inch on its outer surface, is adapted to receive a spout and cap assembly which includes a retractable spout 37. The retractable spout 37 allows a user to transfer fuel from the cavity 29 of module 24 to a jeep, light armored vehicle, truck, HHWV or other military vehicle used in a combat area.

Figure 3:
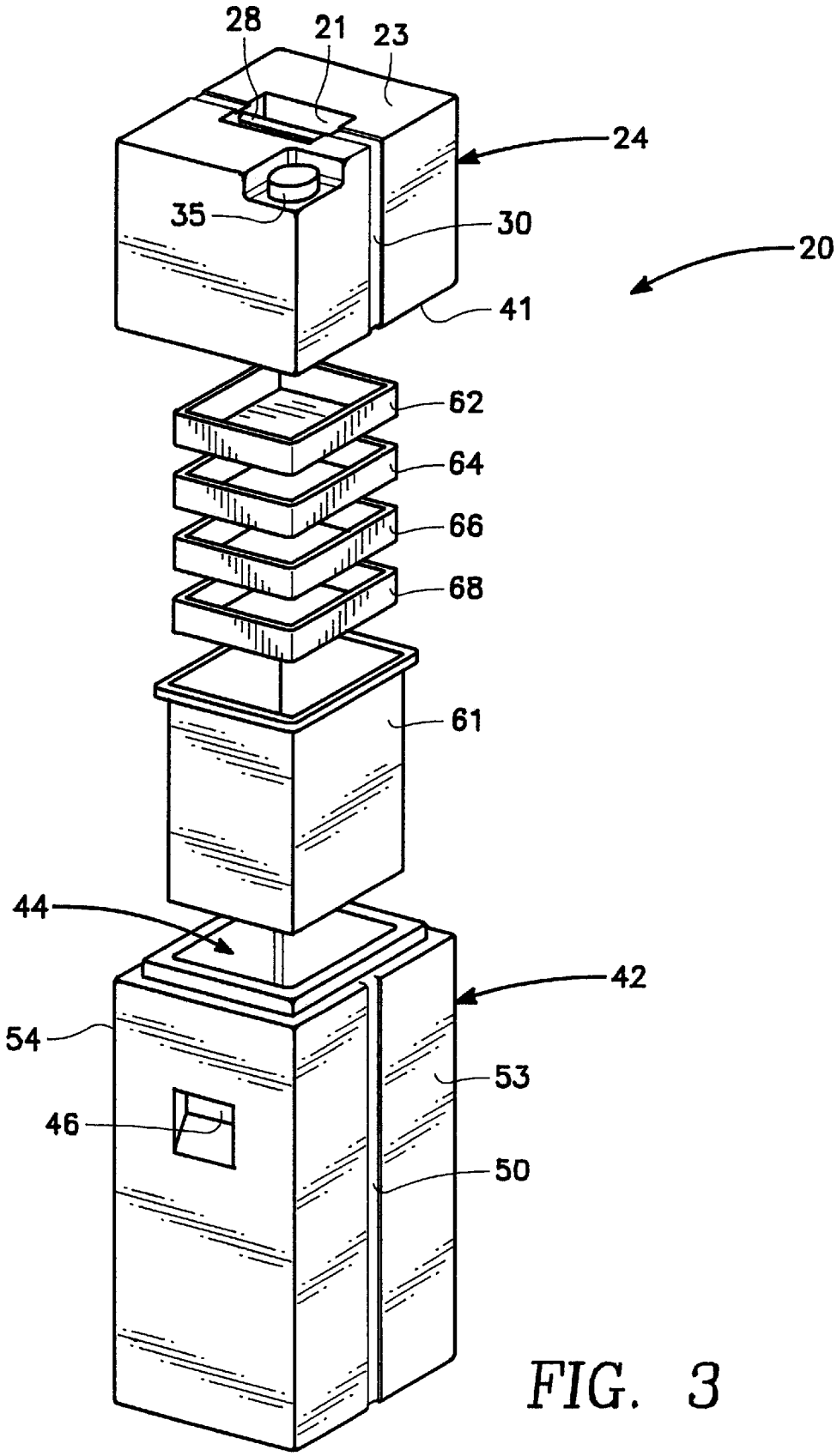
FIG. 3 is an exploded view illustrating the individual components of the modular combat load unit of FIG. 1.
Figure 4:
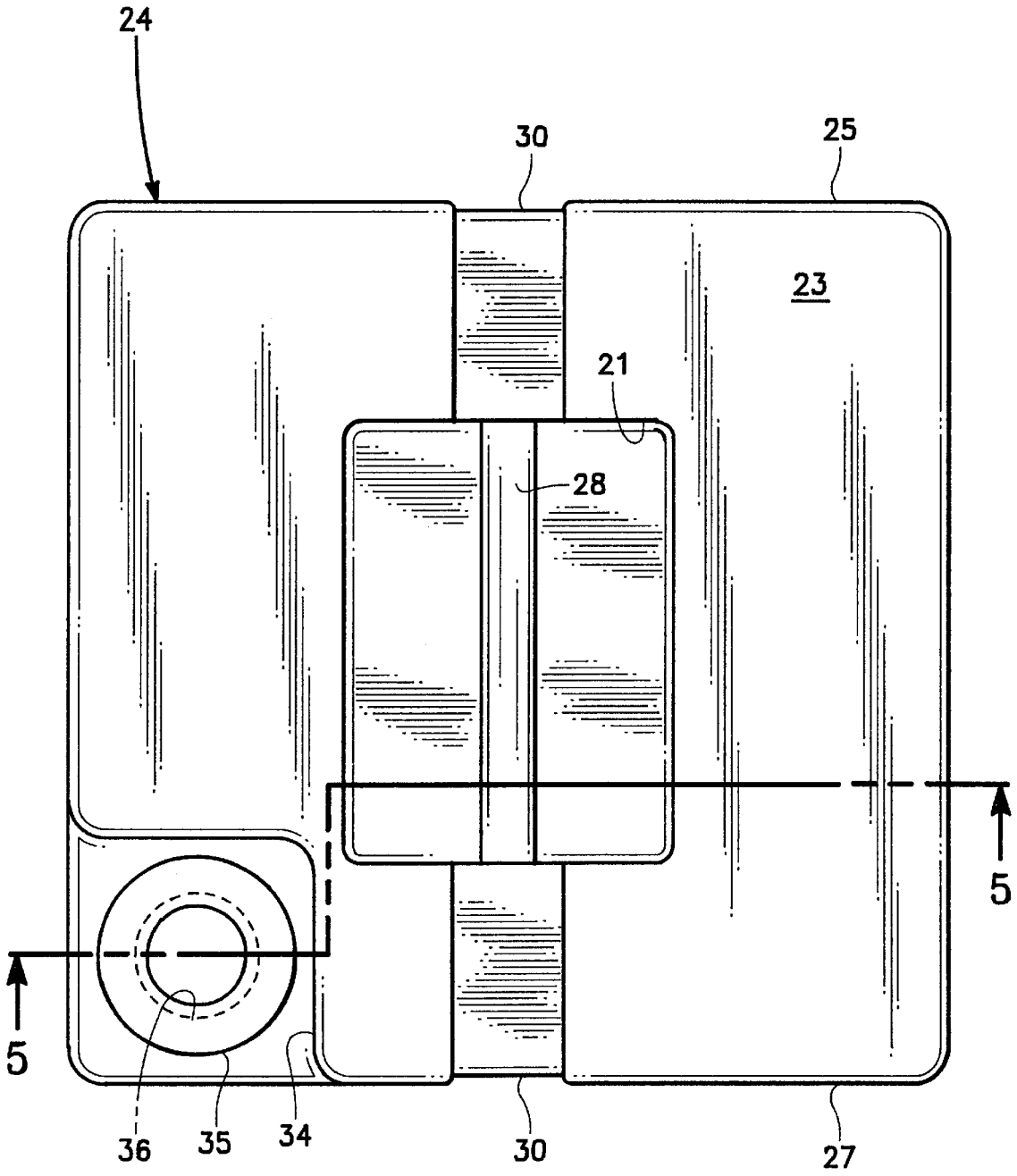
FIG. 4 is a top view of the water/fuel module for the modular combat load unit of FIG. 3.
Figure 5:
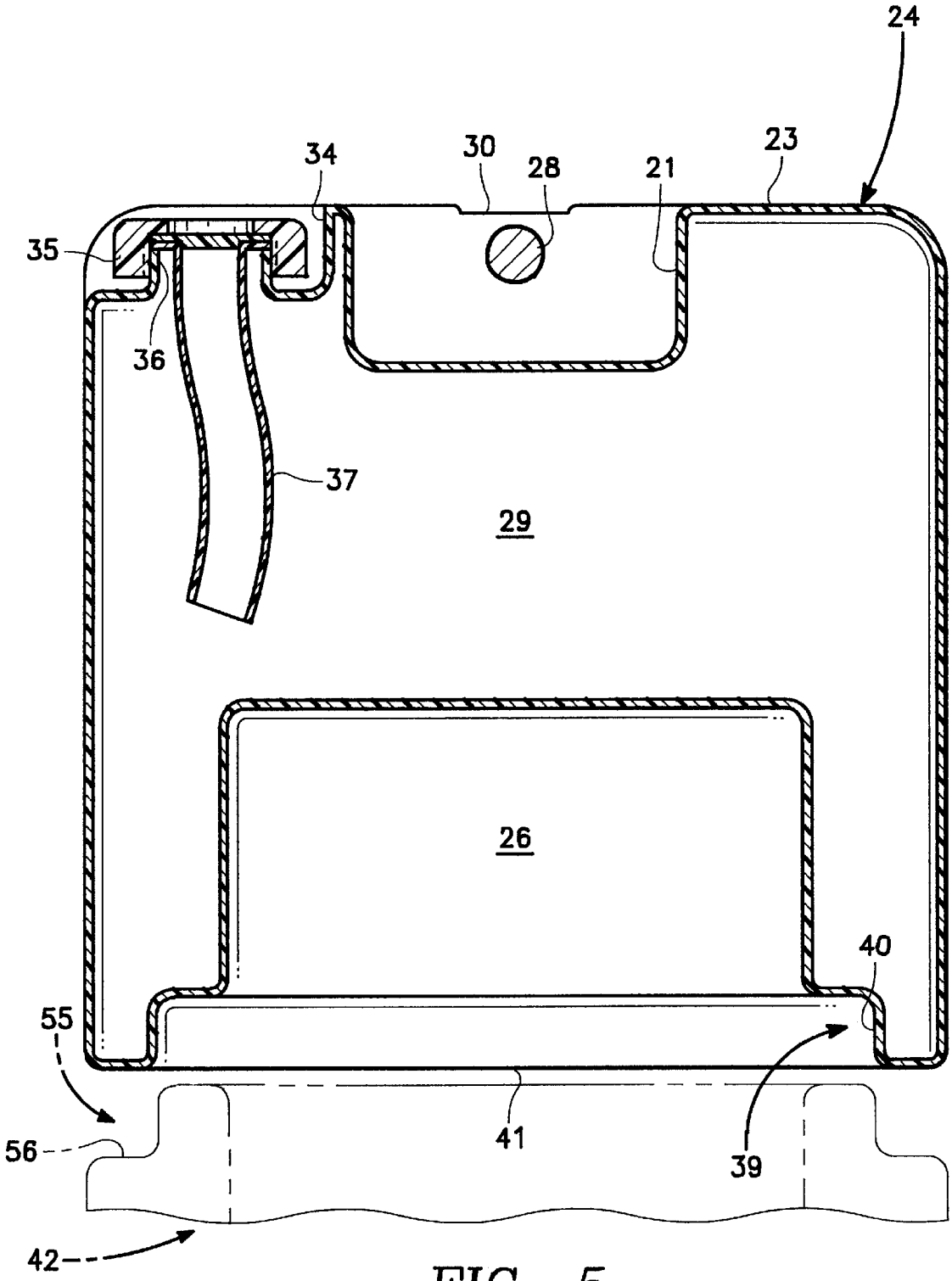
FIG. 5 is a side view, in partial section, of the water/fuel module for the modular combat load unit of FIG. 3.
Figure 6:
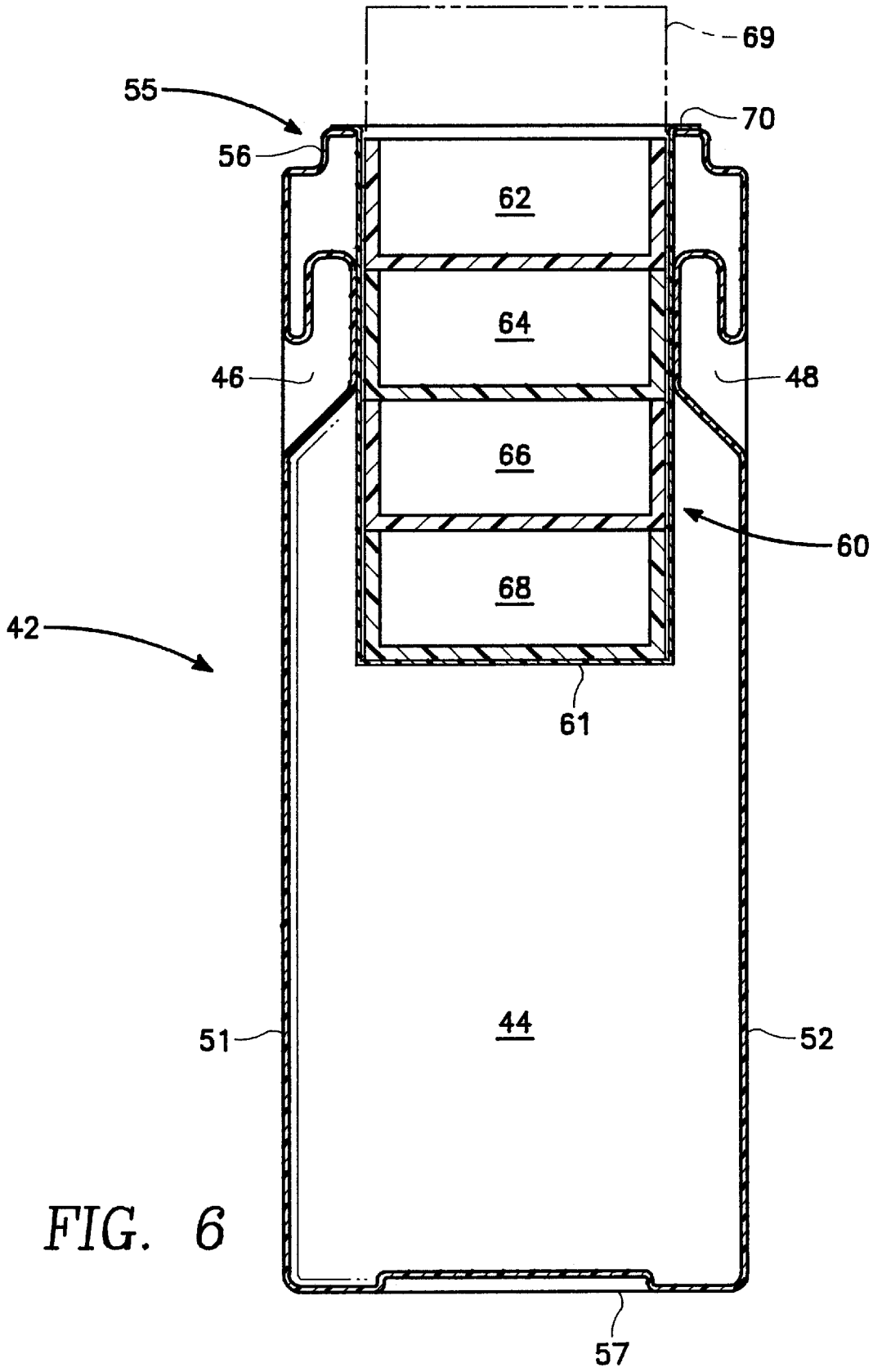
FIG. 6 is a side view, in partial section, of the mission requirements module of FIG. 3 and the field pack module assembly which is positioned within the interior of the mission requirements module.

Referring to FIGS. 1, 3 and 6, located at the bottom end 41 of module 24 is alignment/mating surface 39 around its periphery. Alignment/mating surface 39 has an indent 40 on the inner portion thereof which when correctly positioned aligns module 24 with mission requirements module 42.

The modular combat load unit 20 includes mission requirements module 42 which comprises the lower portion of unit 20. The interior 44 of mission requirements module 42 which forms a cavity may be used to store additional medical supplies, food and water, ammunition and other consumables used by military troops in a combat area. Mission requirements module 42 has overall dimensions of 12 inches long by 12 inches wide by 30 inches high. Mission requirements module 42 has a pair of handles 46 and 48 positioned respectively on opposite side walls 51 and 52 of module 42 in proximity to the upper end of module 42. Mission requirements module 42 also includes a centrally located one eight inch indent 50 which is identical to and aligns with the indent 30 of module 24. Indent 50 is also adapted to receive channel strap 32 which is used to secure water fuel module 24 to mission requirements module 42. Indent 50 runs across the bottom end 57 of mission requirements module 42 and is vertically positioned on opposite side walls 53 and 54 of module 42.

As shown in FIG. 3, the indent 50 is located on side walls 53 and 54 of module 42 which are perpendicular to side walls 51 and 52 of module 42 which has handles 46 and 48.

Located at the upper end of mission requirements module 42 is an alignment/mating surface 55 around its periphery. Alignment/mating surface 55 has an indent 56 located on the outer portion thereof which when correctly positioned aligns module 24 with module 42.

The modular combat load unit 20 also has a field pack module assembly 60 which is inserted or positioned within the cavity formed within interior 44 of mission requirements module 40. The field pack module assembly 60 includes a field pack tray 61 which is eight inches long by eight inches wide by about 14 inches high. The field pack tray 61 holds four field pack storage units 62, 64, 66 and 68 which are stacked on top of one another and fit within field pack tray 61. A fifth field pack storage unit 69 may be stacked on top of the four field pack storage units 62, 62, 66 and 68 contained within tray 61. Field pack storage unit 69 is positioned within the rectangular shaped wash basin 26 of module 24 when modular combat load units 20 is fully assembled.

The five field pack storage trays 62, 64, 66 and 68 are each approximately eight inches long by eight inches wide by 3.6 inches high.

Field pack storage unit 62 is adapted to hold food/rations sufficient to last a soldier one day in a combat environment and weighs about 4.18 lbs. The rations may be stored in plastic containers or cans or any other type of food container which fits within field pack storage unit 62.

Field pack storage unit 64 is adapted to hold about 1.4 gallons of drinking water which is also sufficient to last a soldier one day in a combat environment. The drinking water may be stored within individual plastic bottles or containers which fit within field pack storage unit 64.

Field pack storage unit 66 is adapted to store ammunition for use by a soldier in a combat environment and weighs about 3.31 lbs. The ammunition stored in field pack storage unit 66 may includes bullets for an M-16 rifle or a fifty caliber machine gun or hand grenades or other types of munitions used in a combat environment.

Field pack storage unit 68 is a general purpose storage unit which mat be used to store a medical kit or other medical supplies.

Field pack storage unit 69 is also a general purpose storage unit which may be used to store additional rations or water for use by a soldier in a combat environment.

Field pack tray 61 has a 13/16 inch lip 70 at its upper end which extends outward from the body of field pack tray 61. When modular combat load units 20 is fully assembled, lip 70 of tray 61 is sandwiched between mating surface 39 of module 24 and mating surface 55 of module 42. This, in turn, secures field pack tray 61 within the interior 44 of mission requirements module 42.

At this time it should be noted that field pack tray 61 may be modified to accommodate five field pack storage units. When modified to hold five field pack storage units the overall length about 3.5 inches. It should also be noted that field pack tray 61 may be modified to accommodate only three field pack storage units which would require that the overall length be decreased by about 3.5 inches.

It should also be noted that water/fuel module 24, mission requirements module 42, field pack tray 61 and field pack storage units 62, 64, 66, 68 and 69 may be fabricated from a plastic which is relatively easy to dispose by incineration or other disposal means.

From the foregoing, it may readily be seen that the present invention comprises a new, unique and exceedingly useful modular combat load system for transporting consumables to a combat environment which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A modular combat load system for supplying soldiers within a military unit with mission critical consumable supplies in a combat environment, comprising:

(a) a plurality of modular combat load units stacked side by side on a pallet, each of said plurality of modular combat load units having an upper storage module, a lower storage module affixed to said upper storage module and removable therefrom and an internal storage module positioned within said lower storage module;

(b) said upper storage module having an interior adapted to store a fluid, said upper storage module including:

(i) a top end having a generally rectangular shape which approximates a square;

(ii) a bottom end having a generally rectangular shaped wash basin formed within a lower portion of the interior of said upper storage module;

(iii) four side walls extending vertically downward from the top end of said upper storage module to the bottom end of said upper storage module;

(iv) a centrally located indent positioned within the top end of said upper storage module and a pair of the four side walls of said upper storage module which are opposite one another;

(v) a spout and cap assembly retractable spout located in a recess at one corner of the top end of said upper storage module;

(c) said lower storage module having an interior adapted for storage of said mission critical consumable supplies therein, said lower storage module comprising:

(i) a bottom end having a generally rectangular shape which approximates a square;

(ii) a top end which is open;

(iii) four side walls extending vertically upward from the bottom end of said lower storage module to the top end of said lower storage module;

(iv) a centrally located indent positioned within the bottom end of said lower storage module and a first pair of the four side walls of said lower storage module which are opposite one another, the indent of said lower storage module being aligned with the indent of said upper storage module when said upper storage module is affixed to said lower storage module to form one of said modular combat load units;

(d) said interior storage module including a generally rectangular shaped field pack storage tray which approximates a square, said field pack storage tray having first, second, third and fourth field pack storage units contained therein which are stacked on top of one another; and (e) a channel strap having a buckle assembly which fits within the indent of said upper storage module and the indent of said lower storage module, said buckle assembly when buckled securing said upper storage module to said lower storage module and said internal storage module within said lower storage module.

2. The modular combat load system of claim 1 wherein said plurality of modular combat load units stacked side by side on said pallet comprises sixteen modular combat load units stacked side by side on said pallet.

3. The modular combat load system of claim 1 wherein the top end of said upper storage module has a handle which allows a user to transport said upper storage module from one location to another location.

4. The modular combat load system of claim 1 wherein the fluid stored within the interior of said upper storage module comprises about five gallons of water.

5. The modular combat load system of claim 1 wherein a second pair of the four side walls of said lower storage module which are opposite one another have handles which allow a user to transport said lower storage module from one location to another location.

6. The modular combat load system of claim 1 wherein said field pack storage tray has an overall dimension of eight inches long by eight inches wide by about fourteen inches high.

7. The modular combat load system of claim 1 wherein said first, second, third and fourth field pack storage units are adapted to store said mission critical consumable supplies in a quantity which is sufficient for a soldier for one day in said combat environment.

8. The modular combat load system of claim 7 wherein said mission critical consumable supplies include about 4.18 lbs of rations stored in said first field pack storage unit, about 1.4 gallons of drinking water stored in said second field pack storage unit; ammunition stored in said third field pack storage unit and medical supplies stored in said fourth field pack storage unit.

9. The modular combat load system of claim 1 wherein the wash basin of said modular unit is adapted for storage of a fifth field pack storage unit stacked on top of one of said first, second, third and fourth field pack storage units contained within said field pack storage tray.

10. The modular combat load system of claim 9 wherein each of said first, second, third, fourth and fifth field pack storage units is approximately eight inches long by eight inches wide by 3.6 inches high.

11. The modular combat load system of claim 1 wherein each of said plurality of modular combat load units has an overall dimension of 12 inches long by 12 inches wide by 42 inches high and an approximate weight of 130.33 lbs.

12. A modular combat load system for supplying soldiers within a military unit with mission critical consumable supplies in a combat environment, comprising:

(a) sixteen modular combat load units stacked side by side on a pallet, each of said sixteen modular combat load units having an upper storage module, a lower storage module affixed to said upper storage module and removable therefrom and an internal storage module positioned within said lower storage module;

(b) said upper storage module having an interior adapted to store a fluid, said upper storage module including:

(i) a top end having a generally rectangular shape which approximates a square;

(ii) a bottom end having a generally rectangular shaped wash basin formed within a lower portion of the interior of said upper storage module, the bottom end of said upper storage module having a mating surface around the periphery thereof which includes an indent positioned on an inner portion of the mating surface of said upper storage module;

(iii) four side walls extending vertically downward from the top end of said upper storage module to the bottom end of said upper storage module;

(iv) a centrally located indent positioned within the top end of said upper storage module and a pair of the four side walls of said upper storage module which are opposite one another;

(v) a spout and cap assembly retractable spout located in a recess at one corner of the top end of said upper storage module;

(c) said lower storage module having an interior adapted for storage of said mission critical consumable supplies therein, said lower storage module comprising:

(i) a bottom end having a generally rectangular shape which approximates a square;

(ii) a top end which is open, the top end of said lower storage module having a mating surface around the periphery thereof which includes an indent positioned on an outer portion of the mating surface of said lower storage module;

(iii) four side walls extending vertically upward from the bottom end of said lower storage module to the top end of said lower storage module;

(iv) a centrally located indent positioned within the bottom end of said lower storage module and a first pair of the four side walls of said lower storage module which are opposite one another, the mating surface of said upper storage module when positioned adjacent to the mating surface of said lower storage module aligning said lower storage module with said upper storage module, the indent of said lower storage module then being aligned with the indent of said upper storage module;

(d) said interior storage module including a generally rectangular shaped field pack storage tray which approximates a square, said field pack storage tray having first, second, third and fourth field pack storage units contained therein which are stacked on top of one another; and (e) a channel strap having a buckle assembly which fits within the indent of said upper storage module and the indent of said lower storage module, said buckle assembly when buckled securing said upper storage module to said lower storage module and said internal storage module within said lower storage module, the mating surface of said upper storage module when positioned adjacent to the mating surface of said lower storage module aligning said lower storage module with said upper storage module.

13. The modular combat load system of claim 12 wherein the top end of said upper storage module has a handle which allows a user to transport said upper storage module from one location to another location.

14. The modular combat load system of claim 12 wherein the fluid stored within the interior of said upper storage module comprises about five gallons of water.

15. The modular combat load system of claim 12 wherein a second pair of the four side walls of said lower storage module which are opposite one another have handles which allow a user to transport said lower storage module from one location to another location.

16. The modular combat load system of claim 12 wherein said field pack storage tray has an overall dimension of eight inches long by eight inches wide by about fourteen inches high.

17. The modular combat load system of claim 12 wherein said first, second, third and fourth field pack storage units are adapted to store said mission critical consumable supplies in a quantity which is sufficient for a soldier for one day in said combat environment.

18. The modular combat load system of claim 17 wherein said mission critical consumable supplies include about 4.18 lbs of rations stored in said first field pack storage unit, about 1.4 gallons of drinking water stored in said second field pack storage unit; ammunition stored in said third field pack storage unit and medical supplies stored in said fourth field pack storage unit.

19. The modular combat load system of claim 17 wherein the wash basin of said modular unit is adapted for storage of a fifth field pack storage unit stacked on top of one of said first, second, third and fourth field pack storage units contained within said field pack storage tray.

20. The modular combat load system of claim 19 wherein each of said first, second, third, fourth and fifth field pack storage units is approximately eight inches long by eight inches wide by 3.6 inches high.

21. The modular combat load system of claim 12 wherein each of said sixteen modular combat load units has an overall dimension of 12 inches long by 12 inches wide by 42 inches high and an approximate weight of 130.33 lbs.

* * * * *